US007326151B2

(12) United States Patent
Peterson et al.

(10) Patent No.: US 7,326,151 B2
(45) Date of Patent: Feb. 5, 2008

(54) BICYCLE TRAINER

(76) Inventors: Lewis Dale Peterson, 3428 Sycamor Dr., San Luis Obispo, CA (US) 93401; Benjamin John Matthias, 610 B Couper, San Luis Obispo, CA (US) 93405; Dewey Robert Lucero, 110 Orange Dr., San Luis Obispo, CA (US) 93405

( * ) Notice: Subject to any disclaimer, the term of this patent is extended or adjusted under 35 U.S.C. 154(b) by 862 days.

(21) Appl. No.: 10/800,314

(22) Filed: Mar. 15, 2004

(65) Prior Publication Data

US 2005/0209064 A1 Sep. 22, 2005

(51) Int. Cl.
*A63B 69/16* (2006.01)

(52) U.S. Cl. ..... 482/61; 482/57

(58) Field of Classification Search ..... 482/57–65, 482/89; 434/61, 67, 247; 601/36; 211/22
See application file for complete search history.

(56) References Cited

U.S. PATENT DOCUMENTS

| | | | | |
|---|---|---|---|---|
| 2,450,979 A | | 10/1948 | Moller | |
| 2,793,877 A | | 5/1957 | Meier | |
| 4,082,265 A | | 4/1978 | Berkes | |
| 4,415,152 A | | 11/1983 | Smith | |
| 4,580,983 A | | 4/1986 | Cassini | |
| 4,750,737 A | * | 6/1988 | Smith | 482/61 |
| 4,817,939 A | * | 4/1989 | Augspurger et al. | 482/61 |
| 4,925,183 A | | 5/1990 | Kim | |
| 5,050,865 A | | 9/1991 | Augspurger | |
| 5,240,417 A | | 8/1993 | Smithson | |
| 5,533,899 A | * | 7/1996 | Young | 434/61 |
| 5,662,559 A | | 9/1997 | Vasquez | |
| 6,056,672 A | * | 5/2000 | Carbonell Tendero | 482/57 |
| 6,126,577 A | * | 10/2000 | Chang | 482/57 |
| 6,500,098 B1 | | 12/2002 | Werner | |
| 2004/0053751 A1 | * | 3/2004 | Pizolato | 482/61 |

* cited by examiner

*Primary Examiner*—Jerome Donnelly
*Assistant Examiner*—Tam Nguyen
(74) *Attorney, Agent, or Firm*—J. Troy Gray

(57) ABSTRACT

A bicycle trainer adapted to support a conventional bicycle with the front wheel removed. The bicycle is attached to a pivot frame at the front forks and the rear axle. The pivot frame is pivotably attached to the base frame and supported in a substantially upright position by springs. Both the bicycle and pivot frame pivot about an imaginary tire contact-line, which simulates real bicycle riding conditions associated with bicycle sprinting and hill climbing.

9 Claims, 3 Drawing Sheets

BICYCLE TRAINER

CROSS-REFERENCE TO RELATED APPLICATION

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

1. Field of the Invention

This invention relates to exercise equipment and more particularly to an improved bicycle trainer.

2. The Prior Art

Many individuals ride bicycles for training and exercise. However, because of weather and other variables many individuals choose to ride a stationary bicycle trainer as an alternative to riding a bicycle.

Most bicycle trainers on the market have mounted frames and offer no movement of the bicycle other than the pedals and crank. This is a problem because these trainers do not permit a person to simulate sprinting and hill climbing by allowing side-to-side pivoting movement of the bicycle as experienced in real riding conditions.

Other bicycle trainers have tried to solve this problem by allowing the rider to ride his or her bicycle on a roller-type training device. These types of trainers are difficult to ride because there is no upright restoring force and the rider must maintain balance by positioning the bicycle under his or her body in method different from actual riding conditions. Roller type training devices are also dangerous because they do not secure the bicycle and there is a potential for falling.

A more recent approach to this problem is shown in Vasquez's U.S. Pat. No. 5,662,559 issued Sep. 2, 1997.Vasquez's bicycle trainer has a side-suspension system for maintaining the bicycle in a generally upright position on a roller type training device while still allowing some movement and tilting of the bicycle to simulate outdoor normal riding conditions. However, his device does not have an upright restoring force, but only a side-suspension system that permits a range of lateral movements stretching across the surface of the rollers.

Quent Augspurger and Charles H. Bartlett received U.S. Pat. No. 4,817,939 on Apr. 4, 1989 for their Cycle Training Device. Their device has a wheel support which includes opposed strut or shock absorbers which attach at one end to the rear wheel axle of the bicycle and which are pivotably secured at their opposite ends to the frame to permit limited angular tilting or freedom of motion of the bicycle. However, this device only allows limited tilting because the upright restoring force is only applied to the rear wheel axle of the bicycle. When a person simulates sprinting or hill climbing they rise from the seat and shift their weight forward onto the front handlebars and forks while pumping side to side. The Augspurger device does not offer an upright restoring force through the front forks and this causes frame twisting while only allowing limited angular tilting.

With this in mind the inventor set out to create a better bicycle trainer.

BRIEF SUMMARY OF THE INVENTION

It was the Inventor's objective to create a bicycle training device that would simulate real riding conditions including simulation of sprinting and hill climbing.

This objective has been met with the present invention. A bicycle with its front wheel removed is supported at the axle mounting of the front forks and at the rear wheel axle. The real wheel axle is attached to a pivot frame which is centered along the tire contact line. The front mounting forks are attached to the other end of the same pivot frame. The pivot frame is held by a support base and is allowed to tilt angularly in relation to the support base. The angular tilt is controlled by springs and shock absorbers mounted on the base frame and connected to the pivot frame. The force that causes a tilted bicycle to become upright is henceforth described as the righting force. The shock absorbers and springs work together to supply a righting force to the pivot frame that in turn provides a righting force to the person and bicycle frame through the front and rear axle locations. This angular tilt and righting force provide a real life feel to a bicycle trainer. As an example, a person riding the present invention would stand up on the pedals, shift his or her weight forward applying additional weight to the handlebars and lean to one side. The springs and shock absorbers would apply a righting force to the person through pivot frame, the front forks and the rear axle.

DETAILED DESCRIPTION OF THE INVENTION

The present invention referred to hereon as the bicycle trainer 10 can be best understood by a study of FIGS. 1, 2, 3, and 4 along with the following description.

Figure 1:
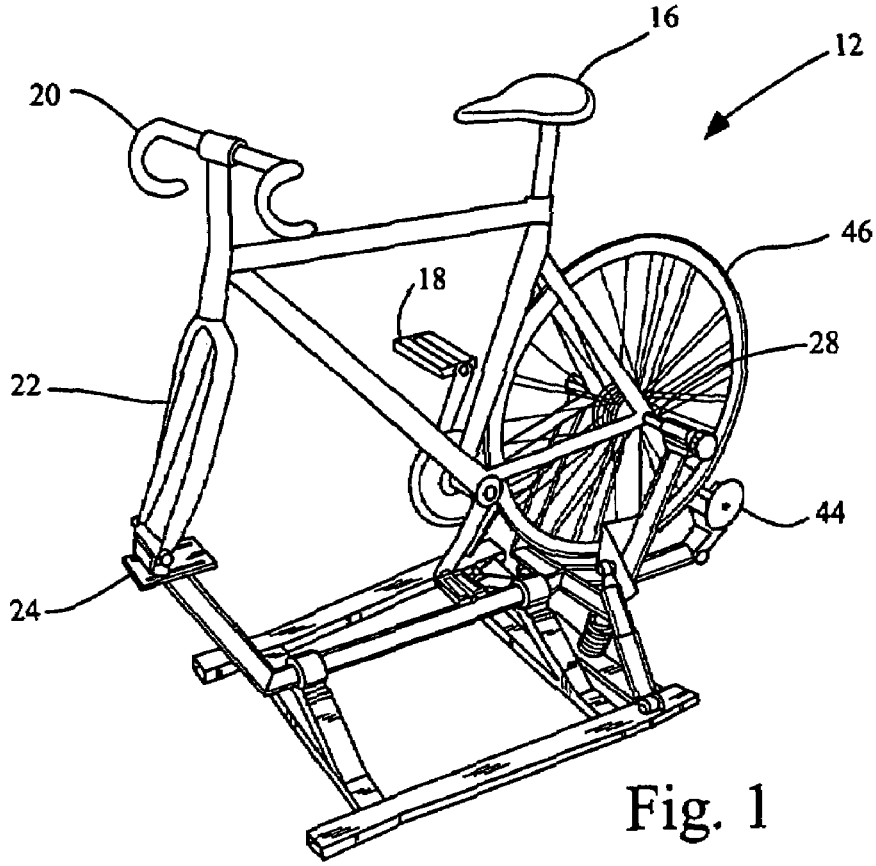
FIG. 1 is a front perspective view of a preferred embodiment of the present invention including a bicycle with the front wheel removed.
Figure 2:
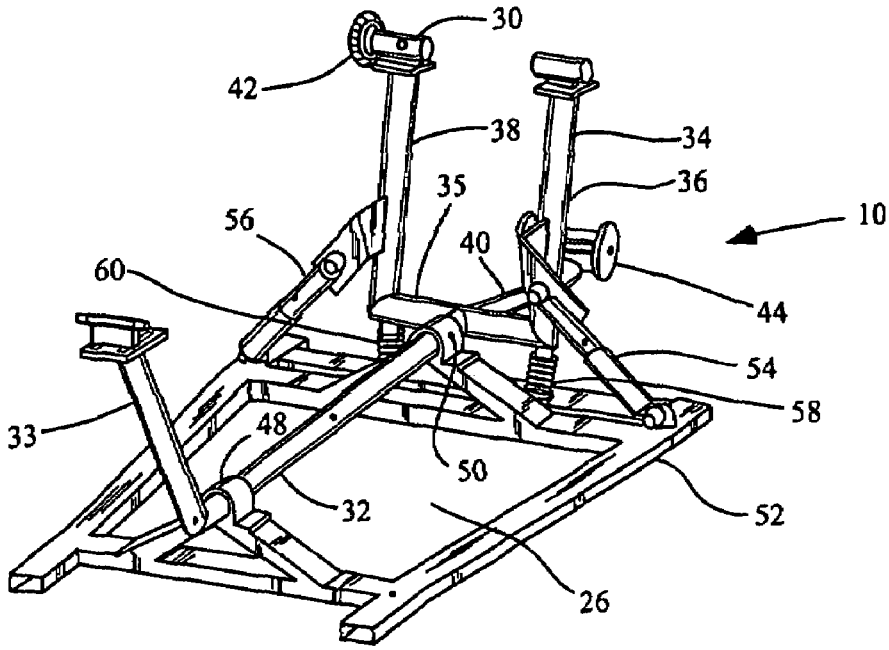
FIG. 2 is a front perspective view of a preferred embodiment of the present invention.
Figure 3:
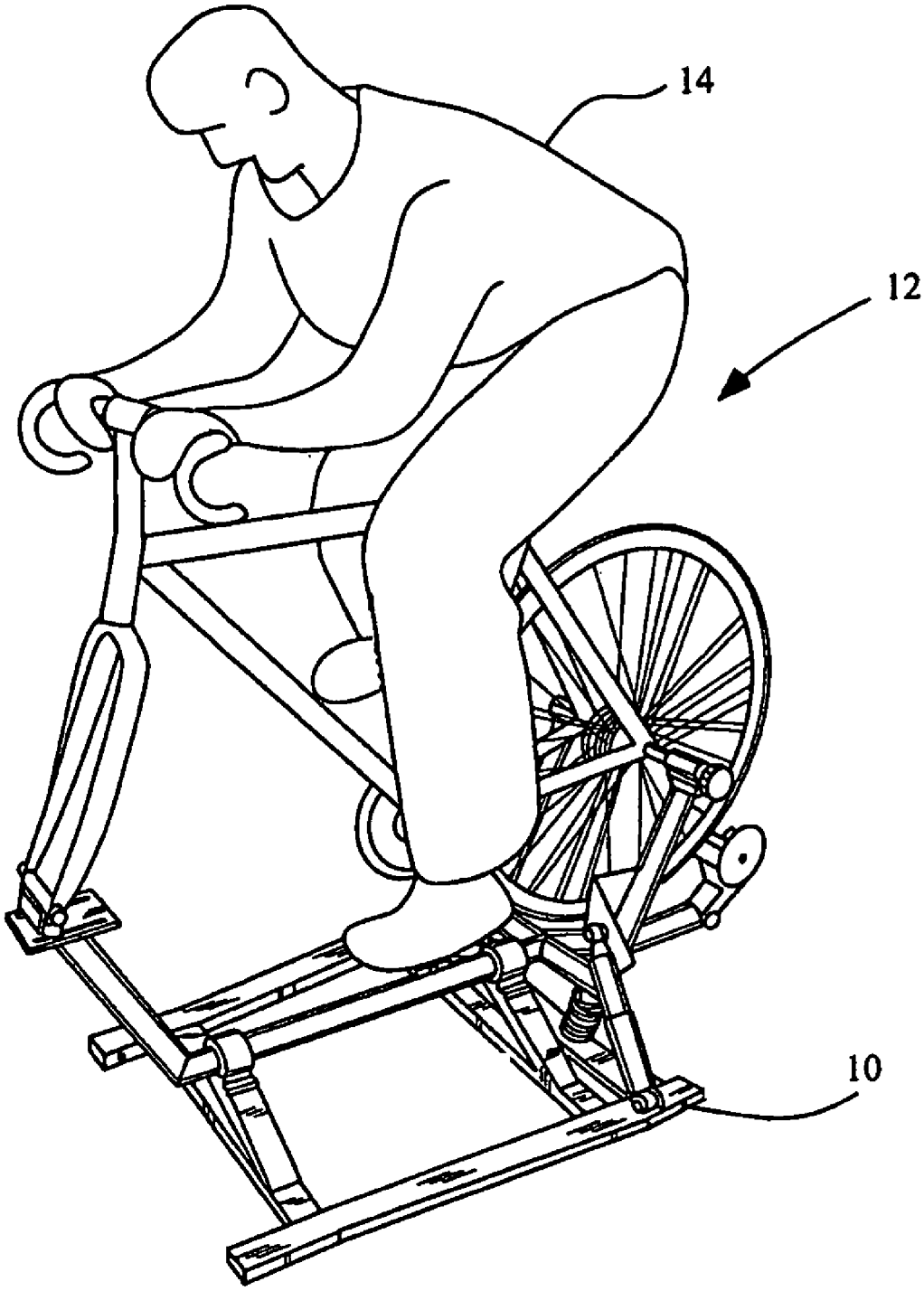
FIG. 3 is a front perspective view of a preferred embodiment of the present invention during use.

The bicycle trainer 10 supports a standard bicycle 12, which supports a person 14. The person 14 in a seated position pedaling is supported by seat 16, the pedals 18, and the handlebars 20. The person 14 in a standing position pedaling as shown in FIG. 3 is supported by the pedals 18 and the handlebars 20 with his or her weight shifted upward and forward towards the handlebars 20.

The bicycle 12 is used in a configuration with the front wheel removed, and the front forks 22 are mounted to the front bicycle mount 24 of the pivot frame 26. The front bicycle mount 24 is a common adjustable fork mount. The front bicycle mount 24 is rigid, but another embodiment allows minimal rotation of the front forks to simulate steering. The rear axle 28 of the bicycle 12 is mounted to the rear bicycle mount 30 of the pivot frame 26 using a common adjustable screw-clamping device 42. The pivot frame 26 consists of a cylindrical horizontal member 32, a front vertical member 33, a rear U-shaped member 34 with a horizontal member 35, a rear vertical member 36, and a rear vertical member 38, additionally there is a rear tail member 40. The rear tail member 40 supports a resistance device 44. The resistance device 44 is a common adjustable fluid, magnetic, or air resistance device, and is in direct contact with the rear wheel 46.

The imaginary tire contact line is defined as the line between the point where the rear wheel 46 would contact the riding surface and the point where the front wheel would contact the riding surface. The pivotably mounted cylindrical horizontal member 32 is substantially collinear with the imaginary tire contact line to simulate leaning and bicycle pivot in real riding conditions.

The pivot frame 26 is pivotably supported along the cylindrical horizontal member 32 by the front pivot coupling 48 and the rear pivot coupling 50. The front pivot coupling 48 is supported by the front of the base frame 52 and the rear pivot coupling is supported by the rear of the base frame 52. The base frame 52 is rectangularly shaped and generally equal in length to the bicycle 12 and generally twice as wide as the handlebars 12 measured at their widest point. The pivot frame 26 is centered over the base frame 52 to provide stability.

Figure 4:
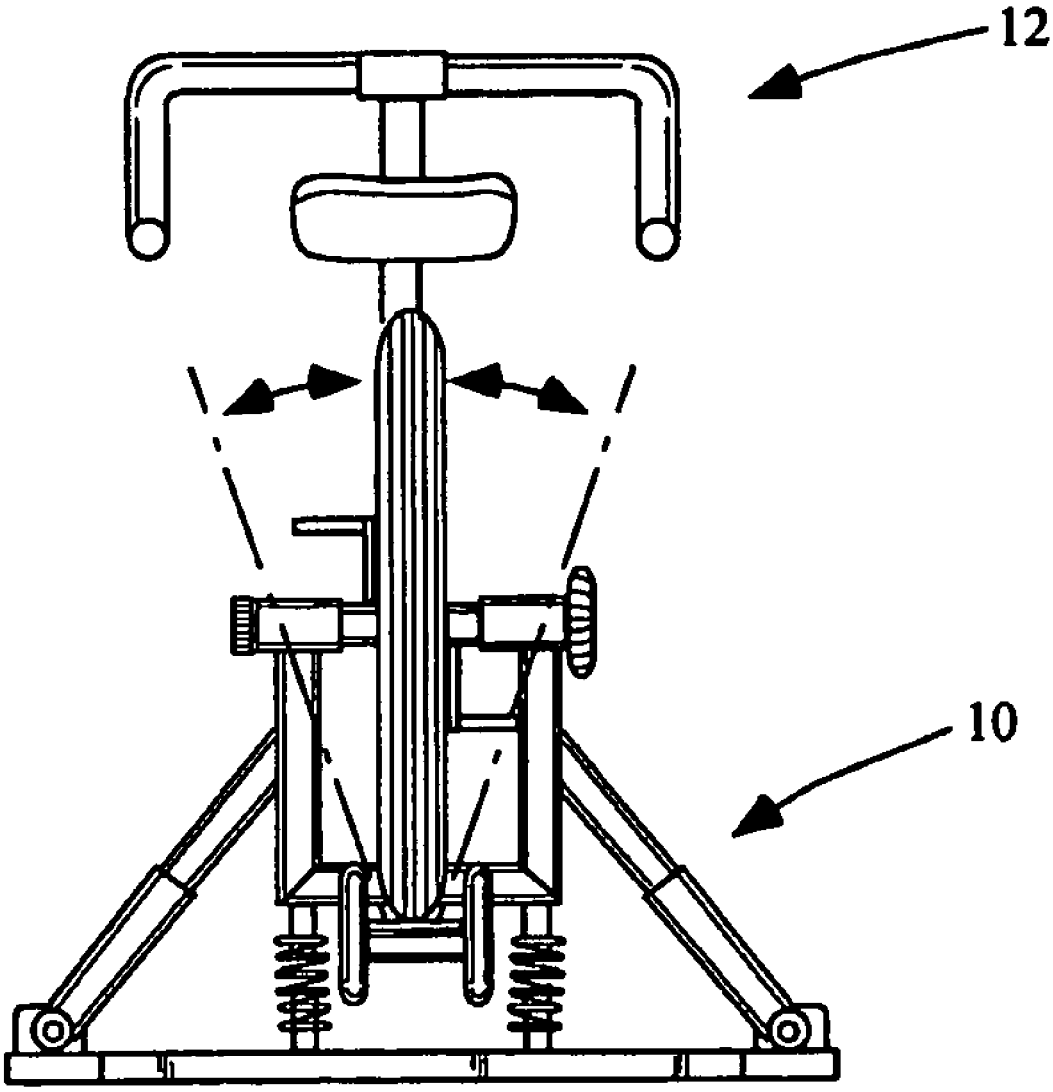
FIG. 4 is a rear view of a preferred embodiment of the present invention.

The right hand and left hand designations are from the perspective of the person 14 on the bicycle 12. The rear vertical members 36 and 38 and the front vertical member 33 are generally upright and perpendicular to the plane of the base frame 52. Although the vertical members are allowed to pivot they are dynamically forced back to an upright position by the left rear spring 58 and the right rear spring 60. The left rear spring 58 is generally in an upright position and is attached at the rear of the base frame 50 and at the intersection of the rear horizontal member 35 and the rear vertical member 36. The right rear spring 60 is generally in an upright position and is attached the rear of the base frame 50 and at the intersection of the rear horizontal member 35 and the rear vertical member 38. The pivoting motion of the vertical members is further controlled by shock absorber 54 and shock absorber 56. Shock absorber 54 is attached to the base frame 52 at the left rear corner and is also attached at a point that is generally in the middle of the rear vertical member 36. Shock absorber 56 is attached to the base frame 52 at the right rear corner and is also attached at a point that is generally in the middle of the rear vertical member 38. The shock absorbers 54 and 56 and the rear springs 58 and 60 work in unison to allow tilting, but to restore substantial perpendicularity between the vertical members of the pivot frame 26 and the plane of the base frame 52. An example of the pivotal tilting is shown in FIG. 4.

What we claim as our invention is:

1. A bicycle trainer for use with a conventional bicycle with the front wheel removed, the trainer comprising:

(a) a pivot frame having substantially rigid contiguous parts including; a substantially vertical front member, having a front fork mount, for detachably supporting the front forks of a bicycle; a substantially vertical rear u-shaped member for detachably supporting the rear axle of said bicycle, an elongated horizontal member defining a longitudinal axis, having a first end supporting said vertical front member and an opposite end supporting said vertical rear member, and further including a tail member substantially in line with said horizontal member;

(b) a base frame having front and rear rotational coupling means for pivotably supporting said horizontal member of said pivot frame;

(c) a resistance device attached at a distal end of said tail member of said pivot frame and adapted to be frictionally coupled to the rear tire of said bicycle;

(d) a spring mechanism having a pair of springs, each having a first end connected to said pivot frame and an opposite end connected to said base frame for pivotably restoring said pivot frame and said bicycle to a substantially vertical neutral position after being pivotably displaced;

whereby a person may simulate bicycle sprinting and hill climbing by pivoting the bicycle on the training during use.

2. The bicycle trainer of claim 1 wherein said base frame includes a rotational coupling supporting the front fork mount to allow for lateral movement of the bicycle on the trainer to simulate leaning and steering of a bicycle during use.

3. The bicycle trainer of claim 1 wherein said pivot frame and said base frame are further pivotably connected by a shock absorber.

4. The bicycle trainer of claim 1 wherein said horizontal member of said pivot frame is a cylindrical member.

5. The bicycle trainer of claim 1 wherein said front and rear rotational couplings are bearings.

6. The bicycle trainer of claim 1 wherein said resistance device is a fluid resistance device, a magnetic resistance device, or an air resistance device.

7. A bicycle trainer to be used by a person for use with a conventional bicycle with the front wheel removed, the trainer comprising:

(a) a pivot frame having substantially rigid contiguous parts including; a substantially vertical front member, having a front fork mount, for detachably supporting the front forks of a bicycle; a substantially vertical rear unshaped member for detachably supporting the rear axle of said bicycle, a cylindrical horizontal member defining an imaginary tire contact line, having a first end supporting said vertical front member and an opposite end supporting said vertical rear member, and further including a tail member extending at a rear portion of said pivot frame and substantially in line with said cylindrical horizontal member;

(b) a rectangular base frame having front and rear rotational coupling means for pivotably supporting said cylindrical horizontal member at opposite ends; thereof (c) a resistance device attached at a distal end of said tail member of said pivot frame and adapted to be frictionally coupled to the rear tire of said bicycle;

(d) a spring mechanism having a pair of springs and a shock absorber having a pair of shocks, each spring and shock having a first end connected to said pivot frame and an opposite end connected to said base frame for pivotably restoring the pivot frame and said bicycle to a substantially vertical neutral position after being pivotably displaced;

whereby a person may simulate bicycle sprinting, hill climbing, and pedaling while standing on the pedals of the bicycle with no seat contact by laterally pivoting the bicycle about the imaginary tire contact line during use.

8. The bicycle trainer of claim 7 wherein said u-shaped vertical member of the pivot frame includes a screw-clamping device to support the rear axle.

9. The bicycle trainer of claim 7 wherein said base frame includes a rotational coupling for supporting the front fork mount to allow for lateral movement of the bicycle on the trainer to simulate leaning and steering of a bicycle during use.

* * * * *